US010244905B2

(12) United States Patent
Tsujita et al.

(10) Patent No.: US 10,244,905 B2
(45) Date of Patent: Apr. 2, 2019

(54) TOILET SEAT APPARATUS

(71) Applicant: TOTO LTD., Kitakyushu-shi, Fukuoka (JP)

(72) Inventors: Masami Tsujita, Kitakyushu (JP); Takeshi Yasugata, Kitakyushu (JP); Yuji Ota, Kitakyushu (JP)

(73) Assignee: TOTO LTD., Kitakyushu-Shi, Fukuoka (JP)

( * ) Notice: Subject to any disclaimer, the term of this patent is extended or adjusted under 35 U.S.C. 154(b) by 0 days.

(21) Appl. No.: 15/366,037

(22) Filed: Dec. 1, 2016

(65) Prior Publication Data

US 2017/0150854 A1 Jun. 1, 2017

(30) Foreign Application Priority Data

Dec. 1, 2015 (JP) ..... 2015-234728
Nov. 16, 2016 (JP) ..... 2016-223103

(51) Int. Cl.

| | |
|---|---|
| ***A47K 13/12*** | (2006.01) |
| ***A47K 13/24*** | (2006.01) |
| ***A47K 13/30*** | (2006.01) |
| ***A47K 13/00*** | (2006.01) |
| *E03D 5/10* | (2006.01) |
| *E03D 9/08* | (2006.01) |
| *E03D 9/052* | (2006.01) |

(52) U.S. Cl.

CPC ..... *A47K 13/12* (2013.01); *A47K 13/00* (2013.01); *A47K 13/24* (2013.01); *A47K 13/305* (2013.01); *A47K 13/307* (2013.01); *E03D 5/105* (2013.01); *E03D 9/052* (2013.01); *E03D 9/08* (2013.01)

(58) Field of Classification Search

CPC ..... A47K 13/12
USPC ..... 4/236
See application file for complete search history.

(56) References Cited

U.S. PATENT DOCUMENTS

2012/0023651 A1* 2/2012 Taylor ..... A47K 13/24 4/234
2013/0117920 A1* 5/2013 Nishimura ..... A47K 13/305 4/237
2013/0133131 A1* 5/2013 Peng ..... A47K 13/302 4/444

FOREIGN PATENT DOCUMENTS

JP 2001-190450 A 7/2001
JP 2003-284655 A 10/2003
JP 2005-198914 A 7/2005

OTHER PUBLICATIONS

Extended European Search Report for 16201701.6 dated Mar. 9, 2017.

* cited by examiner

*Primary Examiner* — Christine Skubinna
(74) *Attorney, Agent, or Firm* — Pearne & Gordon LLP

(57) ABSTRACT

According to one embodiment, a toilet seat apparatus that includes a main part mounted at a rear upper part of a toilet, a toilet seat provided rotatably with respect to the main part, and a radio wave sensor being provided in the interior of the main part and using a radio wave to sense a human body; and in the state in which the toilet seat is lowered, the toilet seat covers the radio wave sensor, and the radio wave passes through the toilet seat and is radiated frontward of the radio wave sensor.

10 Claims, 5 Drawing Sheets

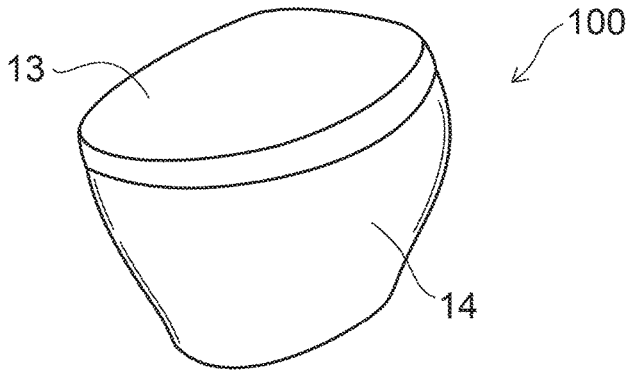
FIG. 1A
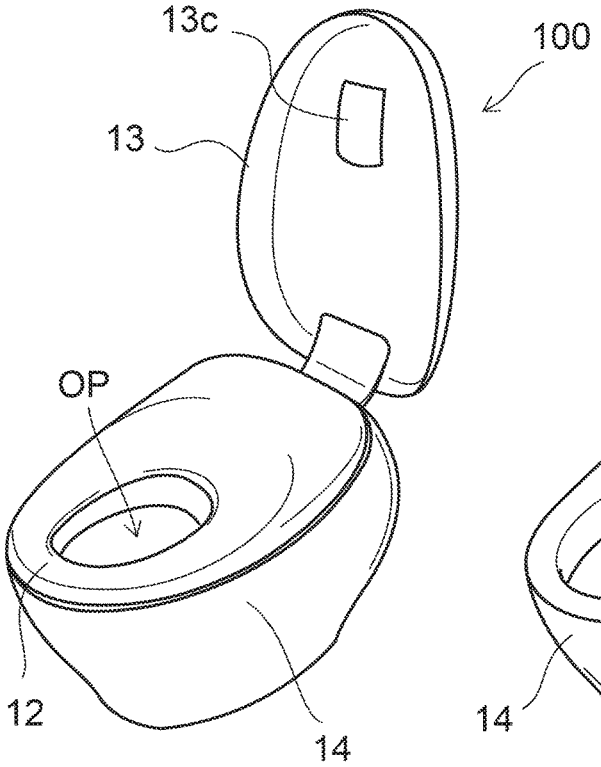
FIG. 1B
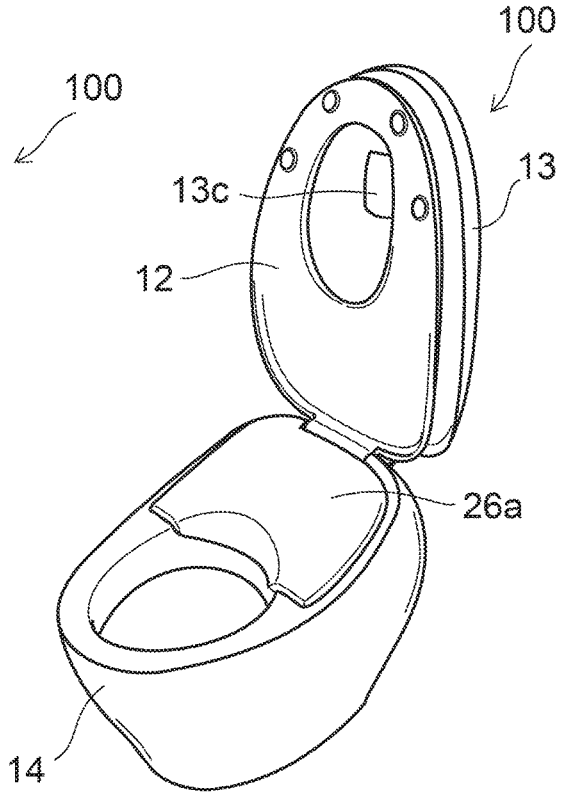
FIG. 1C
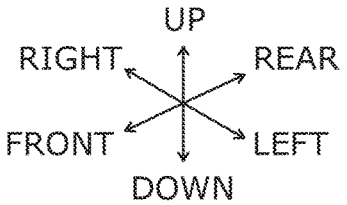

TOILET SEAT APPARATUS

CROSS-REFERENCE TO RELATED APPLICATIONS

This application is based upon and claims the benefit of priority from Japanese Patent Application No. 2015-234728, filed on Dec. 1, 2015 and Japanese Patent Application No. 2016-223103, filed on Nov. 16, 2016; the entire contents of which are incorporated herein by reference.

FIELD

Embodiments of the invention relate to a toilet seat apparatus.

BACKGROUND

A radio wave sensor for sensing a sensing object such as a human body, etc., may be provided in a toilet seat apparatus that is placed and used on a toilet. In such a case, the radio wave sensor may be provided in the interior of a main part of the toilet seat apparatus mounted at the rear upper part of the toilet.

When a radio wave is radiated from the radio wave sensor provided in the interior of the main part, the radio wave passes through the toilet seat, etc., and propagates frontward. At this time, the radio wave is refracted by the toilet seat, etc.; the travel direction of the radio wave is changed; and there is a possibility that the sensing precision of the sensing object may decrease.

SUMMARY

According to one embodiment, a toilet seat apparatus that includes a main part mounted at a rear upper part of a toilet, a toilet seat provided rotatably with respect to the main part, and a radio wave sensor being provided in the interior of the main part and using a radio wave to sense a human body; and in the state in which the toilet seat is lowered, the toilet seat covers the radio wave sensor, and the radio wave passes through the toilet seat and is radiated frontward of the radio wave sensor.

BRIEF DESCRIPTION OF THE DRAWINGS

FIGS. 1A to 1C are perspective views of a toilet apparatus according to the embodiment;

DETAILED DESCRIPTION

Figure 2:
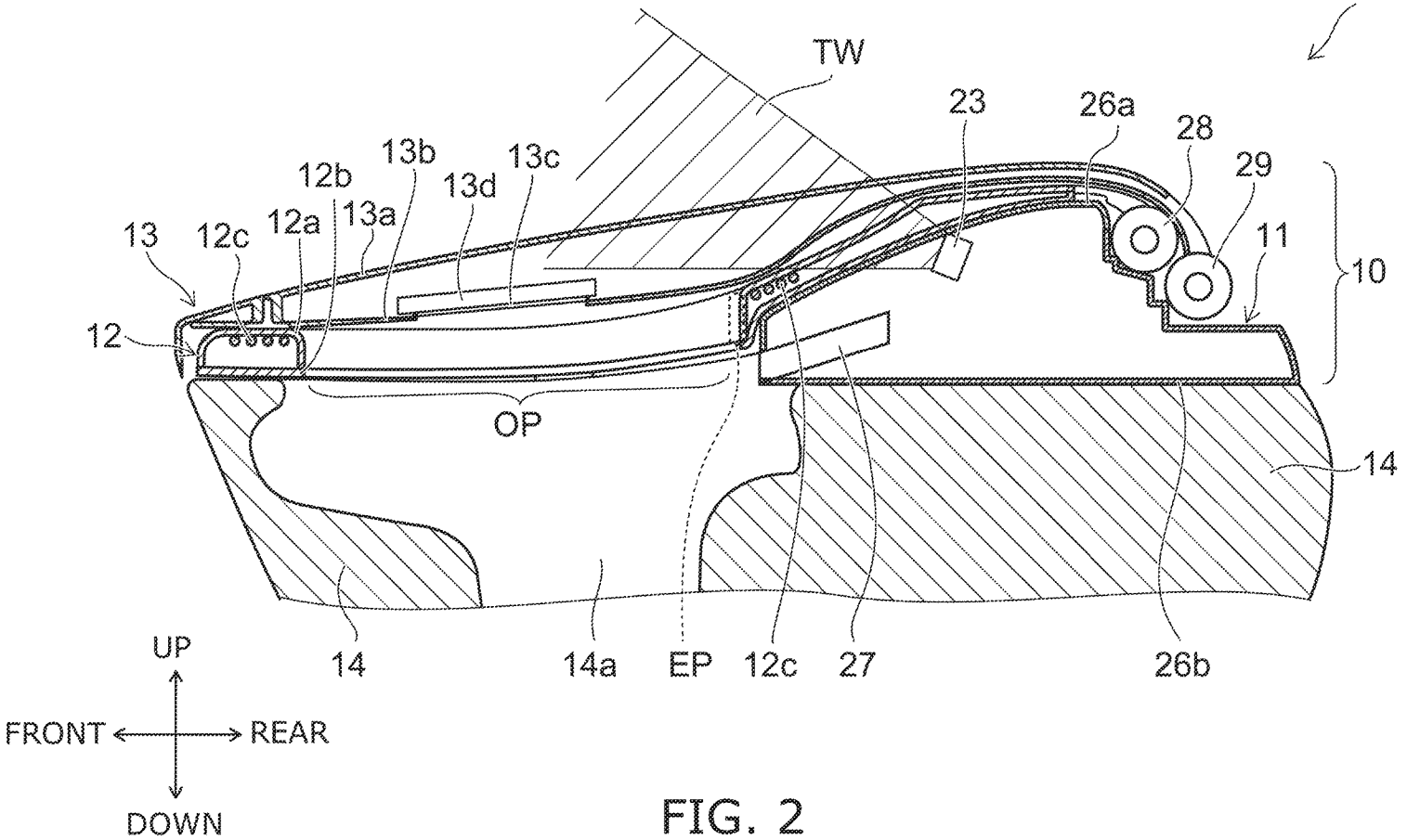
FIG. 2 is an enlarged cross-sectional view of the toilet seat apparatus vicinity of the toilet apparatus according to the embodiment.

A first invention is a toilet seat apparatus that includes a main part mounted at a rear upper part of a toilet, a toilet seat provided rotatably with respect to the main part, and a radio wave sensor being provided in the interior of the main part and using a radio wave to sense a human body; and in the state in which the toilet seat is lowered, the toilet seat covers the radio wave sensor, and the radio wave passes through the toilet seat and is radiated frontward of the radio wave sensor.

According to the toilet seat apparatus, because the toilet seat covers the radio wave sensor, the radio wave that is radiated from the radio wave sensor is radiated frontward of the radio wave sensor without passing through the bent rear end part of the toilet seat. Therefore, it is possible to suppress the decrease of the radio wave intensity frontward of the radio wave sensor and to sense the sensing object of the radio wave sensor with high precision.

A second invention is the toilet seat apparatus of the first invention in which the thickness of the portion of the toilet seat where the radio wave passes through in the state in which the toilet seat is lowered is uniform.

According to the toilet seat apparatus, the change of the travel direction of the radio wave before and after being incident on the toilet seat can be suppressed. Therefore, it is possible to suppress the decrease of the radio wave intensity frontward of the radio wave sensor even further and to sense the sensing object of the radio wave sensor with higher precision.

A third invention is the toilet seat apparatus of the first or second invention in which the radio wave sensor is positioned higher than the rear end part of the opening of the toilet seat in the state in which the toilet seat is lowered.

According to the toilet seat apparatus, it is possible to radiate the radio wave further downward from the radio wave sensor. Therefore, it is possible to sense a child, an older adult, or the like of short stature with higher precision.

A fourth invention is the toilet seat apparatus of any one of the first to third inventions that further includes a heating unit being provided in the toilet seat interior and including a metal; and the radio wave sensor is positioned higher than the heating unit in the state in which the toilet seat is lowered.

According to the toilet seat apparatus, it is possible to radiate the radio wave further downward from the radio wave sensor. Therefore, it is possible to sense a child, an older adult, or the like of short stature with higher precision.

A fifth invention is the toilet seat apparatus of any one of the first to fourth inventions that further includes a toilet seat rotation part supporting the toilet seat pivotally with respect to the main part; and the toilet seat rotation part is provided rearward of the radio wave sensor.

According to the toilet seat apparatus, in the case where the toilet seat is raised, the toilet seat does not exist frontward of the radio wave sensor. Therefore, it is possible to suppress the refraction and attenuation of the radio wave due to the toilet seat in the state in which the toilet seat is raised and to sense the sensing object with higher precision.

A sixth invention is the toilet seat apparatus of the fifth invention that further includes a first toilet seat reinforcing part supporting an upper plate of the toilet seat from below when the upper plate is deformed downward; and the first toilet seat reinforcing part is provided in the interior of the toilet seat above the main part and positioned frontward of the radio wave sensor.

According to the toilet seat apparatus, deformation of the toilet seat can be suppressed; and the likelihood of damage of the toilet seat occurring can be reduced.

A seventh invention is the toilet seat apparatus of the sixth invention that further includes a second toilet seat reinforcing part provided in the interior of the toilet seat above the main part and positioned above and rearward of the radio wave sensor; and the second toilet seat reinforcing part contacts the upper plate of the toilet seat.

According to the toilet seat apparatus, when the toilet seat is rotated by the toilet seat rotation part, the likelihood of damage of the toilet seat occurring can be reduced; and the rotation operation of the toilet seat can be stabilized further. Therefore, misdetection of the toilet seat as a human body is suppressed; and the performance of the radio wave sensor also is stabilized.

An eighth invention is the toilet seat apparatus of the seventh invention in which the radio wave sensor radiates the radio wave frontward through a region between the first toilet seat reinforcing part and the second toilet seat reinforcing part.

According to the toilet seat apparatus, even in the case where the first toilet seat reinforcing part and the second toilet seat reinforcing part are provided, it is possible to suppress the decrease of the radio wave intensity frontward of the radio wave sensor and sense the sensing object with high precision.

A ninth invention is the toilet seat apparatus of any one of the fifth to eighth inventions that further includes a toilet lid, a toilet lid rotation part supporting the toilet lid pivotally with respect to the main part, and a toilet lid reinforcing part linked to the toilet lid rotation part and the toilet lid; the toilet lid rotation part is provided rearward of the radio wave sensor; and the toilet lid reinforcing part is provided from the toilet lid rotation part to a region above the radio wave sensor.

According to the toilet seat apparatus, the likelihood of damage of the toilet lid occurring can be reduced when the toilet lid is rotated by the toilet lid rotation part. Also, the rotation operation of the toilet lid can be stabilized further. Therefore, misdetection of the toilet lid as a human body is suppressed; and the performance of the radio wave sensor also is stabilized.

A tenth invention is the toilet seat apparatus of any one of the first to eighth inventions that further includes a toilet lid including a light source unit; and at least a portion of the radio wave sensor is positioned higher than the light source unit in the state in which the toilet lid is closed.

According to the toilet seat apparatus, it is possible to radiate the radio wave further downward from the radio wave sensor. Therefore, it is possible to sense a child, an older adult, or the like of short stature with higher precision.

According to the embodiments of the invention, a toilet seat apparatus can be provided in which the sensing precision of the sensing object can be increased.

Embodiments of the invention will now be described with reference to the drawings. Similar components in the drawings are marked with the same reference numerals; and a detailed description is omitted as appropriate. Although "up," "down," "front," "rear," "left," etc., are used in the description of the invention in this specification, the view from a user seated on a toilet seat is used as the reference of these directions.

FIGS. 1A to 1C are perspective views of a toilet apparatus according to the embodiment. Specifically, FIG. 1A illustrates the state in which a toilet seat 12 is lowered and a toilet lid 13 is closed. FIG. 1B illustrates the state in which the toilet seat 12 is lowered and the toilet lid 13 is opened. FIG. 1C illustrates the state in which the toilet seat 12 is raised and the toilet lid 13 is opened.

FIG. 2 is an enlarged cross-sectional view of the toilet seat apparatus vicinity of the toilet apparatus according to the embodiment.

Figure 3:
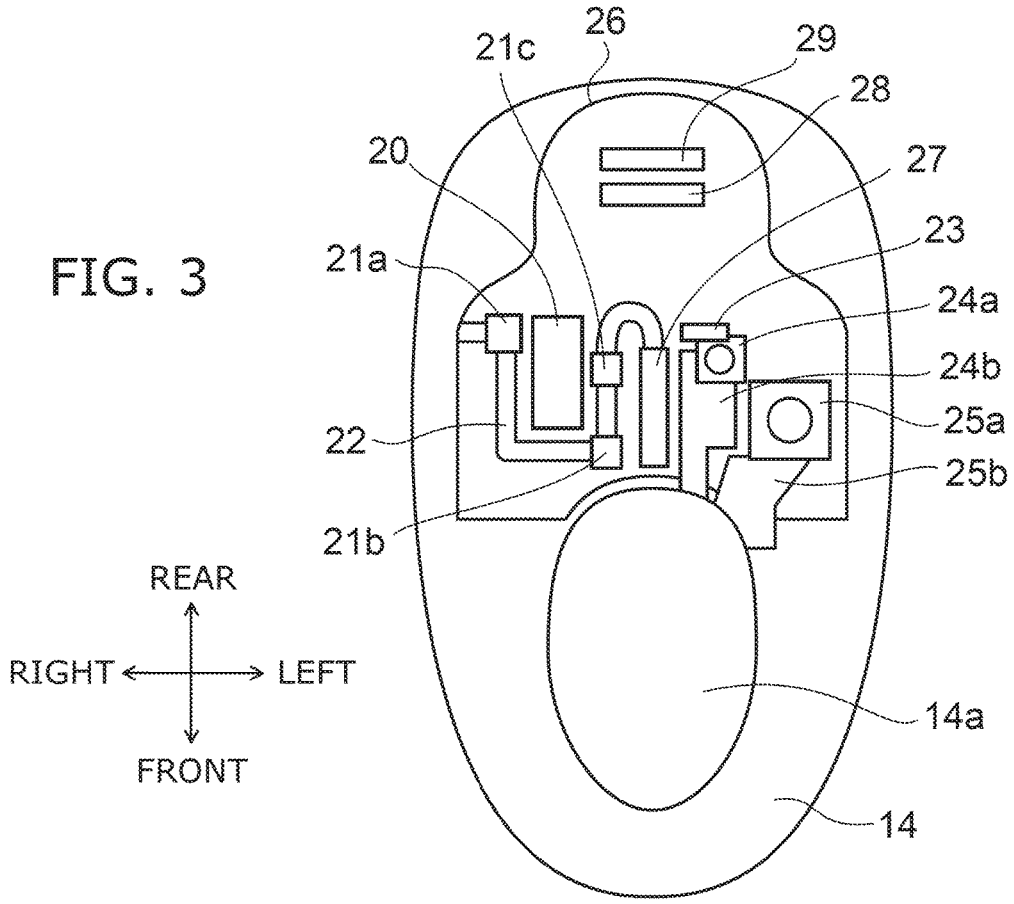
FIG. 3 is a plan view illustrating the internal structure of a main part according to the embodiment.

FIG. 3 is a plan view illustrating the internal structure of a main part according to the embodiment.

To illustrate the internal structure of the main part 11 in FIG. 3, the toilet lid 13, the toilet seat 12, and a portion of a casing 26 are omitted.

As illustrated in FIGS. 1A to 1C and FIG. 2, the toilet apparatus 100 includes a toilet seat apparatus 10 and a toilet 14. The toilet seat apparatus 10 is placed on the toilet 14. The toilet seat apparatus 10 includes the main part 11, the toilet seat 12, the toilet lid 13, a toilet seat rotation part 28, and a toilet lid rotation part 29.

The main part 11 is provided at the rear upper part of the toilet 14. The toilet seat rotation part 28 and the toilet lid rotation part 29 are provided on the main part 11. The toilet seat 12 is supported pivotally with respect to the main part 11 by the toilet seat rotation part 28. The toilet lid 13 also is supported pivotally with respect to the main part 11 by the toilet lid rotation part 29. The vertical operation of the toilet seat 12 and the open/close operation of the toilet lid 13 are performed by driving the toilet seat rotation part 28 and the toilet lid rotation part 29.

As illustrated in FIG. 1A, the toilet seat 12 is covered completely with the toilet lid 13 in the state in which the toilet lid 13 is closed. Thereby, the beauty of the toilet apparatus 100 when not in use can be improved. As illustrated in FIG. 1B and FIG. 1C, the toilet seat 12 has an opening OP at the front; and the toilet seat 12 extends rearward to cover an upper casing 26*a*.

As illustrated in FIG. 2, the main part 11 includes the upper casing 26*a* and a lower casing 26*b*. Also, as illustrated in FIG. 3, the main part 11 includes a controller 20, a solenoid valve 21*a*, a heater 21*b*, a water drain 21*c*, a water supply path 22, a radio wave sensor 23, a drying fan 24*a*, a drying duct 24*b*, a deodorizing fan 25*a*, a deodorizing duct 25*b*, and a nozzle 27 that are provided inside the space surrounded with the upper casing 26*a* and the lower casing 26*b*.

In the toilet apparatus 100 illustrated in FIG. 1A to FIG. 3, the lower casing 26*b* is provided on the inner side of the toilet 14. The components that are included in the main part 11 are disposed inside the lower casing 26*b*; and these components are covered with the upper casing 26*a*.

The nozzle 27 is provided in the horizontal-direction center of the toilet seat apparatus 10. The nozzle 27 is configured to be advanceable and retractable with respect to a bowl 14*a* of the toilet 14. In the state of being advanced into the bowl 14*a*, the nozzle 27 can discharge washing water toward a private part of the user seated on the toilet seat 12.

The water supply path 22 is connected to a water supply source outside the toilet apparatus 100 and supplies the washing water to the nozzle 27. In order from the upstream side, the solenoid valve 21*a*, the heater 21*b*, and the water drain 21*c* are provided in the water supply path 22. The solenoid valve 21*a* controls the inflow of the washing water from the upstream side into the water supply path 22. The heater 21*b* heats the washing water supplied to the water supply path 22 to a temperature suited to the private part wash. The water drain 21*c* includes a not-illustrated valve and is configured so that the washing water supplied to the water supply path 22 can be caused to flow into the bowl 14*a*.

The deodorizing fan 25*a* pulls offensive odors of the interior of the toilet 14 through the deodorizing duct 25*b*, causes the offensive odors to pass through a deodorizing material, and exhausts the offensive odors outside the toilet 14. The drying fan 24*a* pulls air from outside the toilet 14, heats the air by a not-illustrated heater, and supplies the warm air through the drying duct 24*b* toward the private part of the user.

The radio wave sensor 23 is provided at a position that is shifted slightly leftward from the center of the toilet seat apparatus 10. Also, as illustrated in FIG. 2, the radio wave sensor 23 is positioned higher than the nozzle 27 and is provided so that another member is not positioned between the upper casing 26*a* and the radio wave sensor 23.

The radio wave sensor 23 radiates a radio wave toward the front of the toilet apparatus 100 and senses an object such as a human body or the like entering the sensing region. The radio wave sensor 23 also can sense the movement (the velocity, the direction, etc.) of the object by utilizing the doppler effect, etc. The radio wave sensor 23 is, for example, a microwave sensor that utilizes the frequency band of microwaves. Because microwaves pass through substances having relatively small relative dielectric constants such as wood, resin, ceramic, etc., the radio wave sensor 23 can pass through the upper casing 26*a*, the toilet seat 12, the toilet lid 13, etc., to sense the human body and sense the movement state (the velocity) of the human body.

Microwaves are one classification according to the frequency of the radio wave. Generally, microwaves are radio waves (electromagnetic waves) of wavelengths of 100 micrometers to 1 meter and frequencies of 300 megahertzs to 3 terahertzs. Radio waves in this range include decimeter waves (UHF), centimeter waves (SHF), millimeter waves (EHF), and submillimeter waves.

The controller 20 controls the operations of the components included in the toilet apparatus 100. For example, the controller 20 also opens and closes the toilet lid 13, heats the toilet seat 12, washes the bowl 14*a*, etc., according to the sensing result of the user from the radio wave sensor 23.

Again referring to FIG. 2, the toilet seat apparatus 10 according to the embodiment will now be described in more detail.

The toilet seat 12 includes an upper plate 12*a* and a lower plate 12*b*. A hollow is defined between the upper plate 12*a* and the lower plate 12*b*; and a heating unit 12*c* is provided in the space.

In the state in which the toilet seat 12 is lowered, the upper plate 12*a* and the lower plate 12*b* extend in the frontward/rearward direction along the upper surface of the toilet 14 and the upper surface of the upper casing 26 and are connected to the toilet seat rotation part 28 provided rearward of the radio wave sensor 23. Therefore, in the state in which the toilet seat 12 is lowered, the radio wave sensor 23 is covered with the upper plate 12*a* and the lower plate 12*b*. In other words, a portion of the upper plate 12*a* and a portion of the lower plate 12*b* are positioned directly above the radio wave sensor 23 and obliquely upward from the radio wave sensor 23. Accordingly, a radio wave TW that is radiated from the radio wave sensor 23 passes through the upper plate 12*a* and the lower plate 12*b* and spreads frontward of the toilet apparatus 100.

The thicknesses of the upper plate 12*a* and the lower plate 12*b* are uniform at the vicinity of the radio wave sensor 23 (i.e., the portion where the radio wave TW radiated from the radio wave sensor 23 mainly passes through). In other words, at the vicinity of the radio wave sensor 23, the upper surface and lower surface of the upper plate 12*a* are parallel; and the upper surface and lower surface of the lower plate 12*b* are parallel. More specifically, the thicknesses of the upper plate 12*a* and the lower plate 12*b* are uniform in a region where the radio wave TW radiated from the radio wave sensor 23 and passing through the region has a radio wave intensity not less than 30% of the maximum radio wave intensity of the radio wave TW. In other words, in the description of the embodiment, the thickness of the portion being uniform where the radio wave TW passes through means that the thicknesses of the upper plate 12*a* and the lower plate 12*b* are uniform in the region where the radio wave passing through has a radio wave intensity not less than 30% of the maximum radio wave intensity.

For example, the heating unit 12*c* is an induction heating coil including a metal. In the case where the heating unit 12*c* is an induction heating coil, for example, the upper plate 12*a* includes a heating element having a high permeability such as SUS430, etc. In the example illustrated in FIG. 2, multiple induction heating coils are provided; and the induction heating coils each are provided in an annular configuration to surround the opening OP. When a high frequency current is caused to flow in each of the induction heating coils, a magnetic field is generated around the induction heating coil. Due to the magnetic field, an eddy current flows in the heating element of the upper plate 12*a* in the reverse direction of the current flowing through the induction heating coil; and the toilet seat 12 is heated by the Joule heat generated by the eddy current.

The radio wave sensor 23 is provided so that at least a portion of the radio wave sensor 23 is positioned higher than the heating unit 12*c*. In other words, the position in the vertical direction of the at least a portion of the radio wave sensor 23 is on the upper side of the position in the vertical direction of the heating unit 12*c*.

Also, the radio wave sensor 23 is provided so that at least a portion of the radio wave sensor 23 is positioned higher than a rear end part EP of the opening OP. In other words, the position in the vertical direction of the at least a portion of the radio wave sensor 23 is on the upper side of the position in the vertical direction of the rear end part EP.

The toilet lid 13 includes an upper plate 13*a* and a lower plate 13*b*. A hollow is defined between the upper plate 13*a* and the lower plate 13*b*. The lower plate 13*b* has a window 13*c*; and a light source unit 13*d* is provided to be proximal to the window 13*c*. The window 13*c* can transmit ultraviolet light and is provided to be positioned above the bowl 14*a* in the state in which the toilet lid 13 is closed. Sterilization of the bowl 14*a* is performed by ultraviolet rays being irradiated from the light source unit 13*d* on the bowl 14*a* in the state in which the toilet lid 13 is closed.

The thicknesses of the upper plate 13*a* and the lower plate 13*b* are uniform at the vicinity of the radio wave sensor 23. In other words, at the vicinity of the radio wave sensor 23, the upper surface and lower surface of the upper plate 13*a* are parallel; and the upper surface and lower surface of the lower plate 13*b* are parallel.

The radio wave sensor 23 is provided so that at least a portion of the radio wave sensor 23 is positioned higher than the light source unit 13*d*. In other words, the position in the vertical direction of the at least a portion of the radio wave sensor 23 is on the upper side of the position in the vertical direction of the light source unit 13*d*.

The radio wave that is radiated from the radio wave sensor 23 passes above the heating unit 12*c* of the toilet seat 12, the rear end part EP of the opening OP, and the light source unit 13*d* of the toilet lid 13 and travels toward the front of the toilet seat apparatus 10. In other words, the position and orientation of the radio wave sensor 23 are adjusted so that the radio wave radiated from the radio wave sensor 23 passes above these components.

Here, to describe the operations and effects according to the embodiment, problems of another toilet seat apparatus will be described using FIG. 4.

Figure 4:
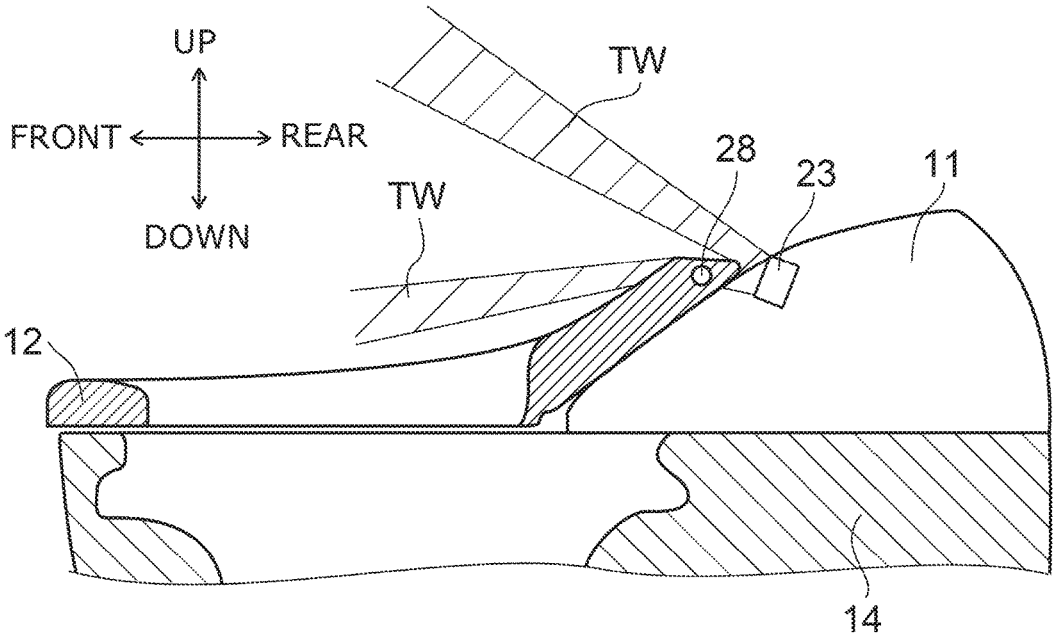
FIG. 4 is a cross-sectional view illustrating a toilet seat apparatus according to a reference example.

FIG. 4 is a cross-sectional view illustrating a toilet seat apparatus according to a reference example.

In the toilet seat apparatus illustrated in FIG. 4, the toilet seat rotation part 28 is provided frontward of the radio wave sensor 23; and the rear end part of the toilet seat 12 is positioned frontward of the radio wave sensor 23. In the case of this toilet seat apparatus, a portion of the radio wave TW radiated toward the front of the radio wave sensor 23 is incident on the rear end part of the toilet seat 12; and another portion propagates without being incident on the toilet seat 12. At this time, the radio wave TW that is incident on the rear end part of the toilet seat 12 is refracted at the interface between the toilet seat 12 and the air.

The rear end part of the toilet seat 12 is bent; and the thickness of the rear end part changes. Also, the refractive indexes of the resin, etc., included in the toilet seat 12 are higher than the refractive index of air. Therefore, as illustrated in FIG. 4, a portion of the radio wave TW travels obliquely upward from the radio wave sensor 23; and another portion travels obliquely downward from the radio wave sensor 23. As a result, it is difficult to radiate the radio wave frontward of the radio wave sensor 23; and a region where the radio wave intensity is small undesirably occurs. If the radio wave intensity is small frontward of the radio wave sensor 23, the strength of the reflected wave from the human body decreases; and the likelihood becomes high that the radio wave sensor 23 cannot correctly sense the user of the toilet apparatus.

Conversely, in the case of the toilet seat apparatus 10 according to the embodiment, the toilet seat 12 covers the radio wave sensor 23; and the rear end of the toilet seat 12 is positioned rearward of the radio wave sensor 23. Therefore, the radio wave TW that is radiated from the radio wave sensor 23 travels frontward of the radio wave sensor 23 without passing through the bent rear end part. In other words, according to the embodiment, it is possible to suppress the decrease of the radio wave intensity frontward of the radio wave sensor 23 and to sense the sensing object such as the user of the toilet apparatus, etc., with high precision.

In the embodiment, the thickness of the toilet seat 12 is uniform at the vicinity of the radio wave sensor 23. Specifically, the thicknesses of the upper plate 12*a* and the lower plate 12*b* included in the toilet seat 12 are uniform at the vicinity of the radio wave sensor 23. Here, if the toilet seat 12 includes a resin, when the radio wave TW radiated from the radio wave sensor 23 is incident on the lower surfaces of the upper plate 12*a* and the lower plate 12*b*, the radio wave TW is refracted according to the refractive index of the resin with respect to air; and when the radio wave TW is incident on the upper surfaces of the upper plate 12*a* and the lower plate 12*b*, the radio wave TW is refracted according to the refractive index of air with respect to the resin. At this time, if the thicknesses of the upper plate 12*a* and the lower plate 12*b* are uniform, the incident angles when incident on the lower surfaces of the upper plate 12*a* and the lower plate 12*b* are equal to the refraction angles when incident on the upper surfaces of the upper plate 12*a* and the lower plate 12*b*. In other words, it is possible to suppress the change of the travel direction of the radio wave before and after being incident on the upper plate 12*a* and the lower plate 12*b*.

Therefore, by setting the thickness of the toilet seat 12 to be uniform at the vicinity of the radio wave sensor 23, it is possible to suppress the decrease of the radio wave intensity frontward of the radio wave sensor 23 even further and to sense the sensing object such as the user of the toilet apparatus, etc., with higher precision.

In the case where the toilet seat apparatus 10 includes the toilet lid 13, similarly to the toilet seat 12, it is desirable for the thicknesses of the upper plate 13*a* and the lower plate 13*b* of the toilet lid 13 to be uniform at the vicinity of the radio wave sensor 23. By employing such a configuration, it is possible to suppress the change of the travel direction of the radio wave TW due to the toilet lid 13.

Because the rear end part EP of the opening OP is curved and the travel direction of the radio wave TW undesirably changes when incident on the rear end part EP, it is desirable for the radio wave sensor 23 to radiate the radio wave TW so that the radio wave TW does not pass through the rear end part EP. In such a case, it is possible to radiate the radio wave further downward from the radio wave sensor 23 by providing the radio wave sensor 23 higher than the rear end part EP. Thereby, it is possible to sense a child, an older adult, or the like of short stature with higher precision.

Similarly, it is desirable for the radio wave sensor 23 to radiate the radio wave TW so that the radio wave TW does not pass through the heating unit 12*c* including the metal. This is because the dielectric constant of the metal is low; and the metal does not transmit the radio wave TW easily. By providing the radio wave sensor 23 higher than the heating unit 12*c*, it is possible to radiate the radio wave further downward from the radio wave sensor 23. Thereby, it is possible to sense a child, an older adult, or the like of short stature with higher precision.

Similarly, it is desirable for the radio wave sensor 23 to radiate the radio wave TW so that the radio wave TW does not pass through the light source unit 13*d* in the state in which the toilet lid 13 is closed. This is because the electrodes, the light emitters, etc., that are included in the light source unit 13*d* include metals and do not transmit the radio wave TW easily. By providing the radio wave sensor 23 higher than the light source unit 13*d*, it is possible to radiate the radio wave further downward from the radio wave sensor 23. Thereby, it is possible to sense a child, an older adult, or the like of short stature with higher precision.

By providing the toilet seat rotation part 28 rearward of the radio wave sensor 23, the toilet seat 12 does not exist frontward of the radio wave sensor 23 when the toilet seat 12 is raised. Therefore, it is possible to suppress the refraction and the attenuation of the radio wave TW by the toilet seat 12 in the state in which the toilet seat 12 is raised and to sense the sensing object with higher precision.

First Modification

Figure 5:
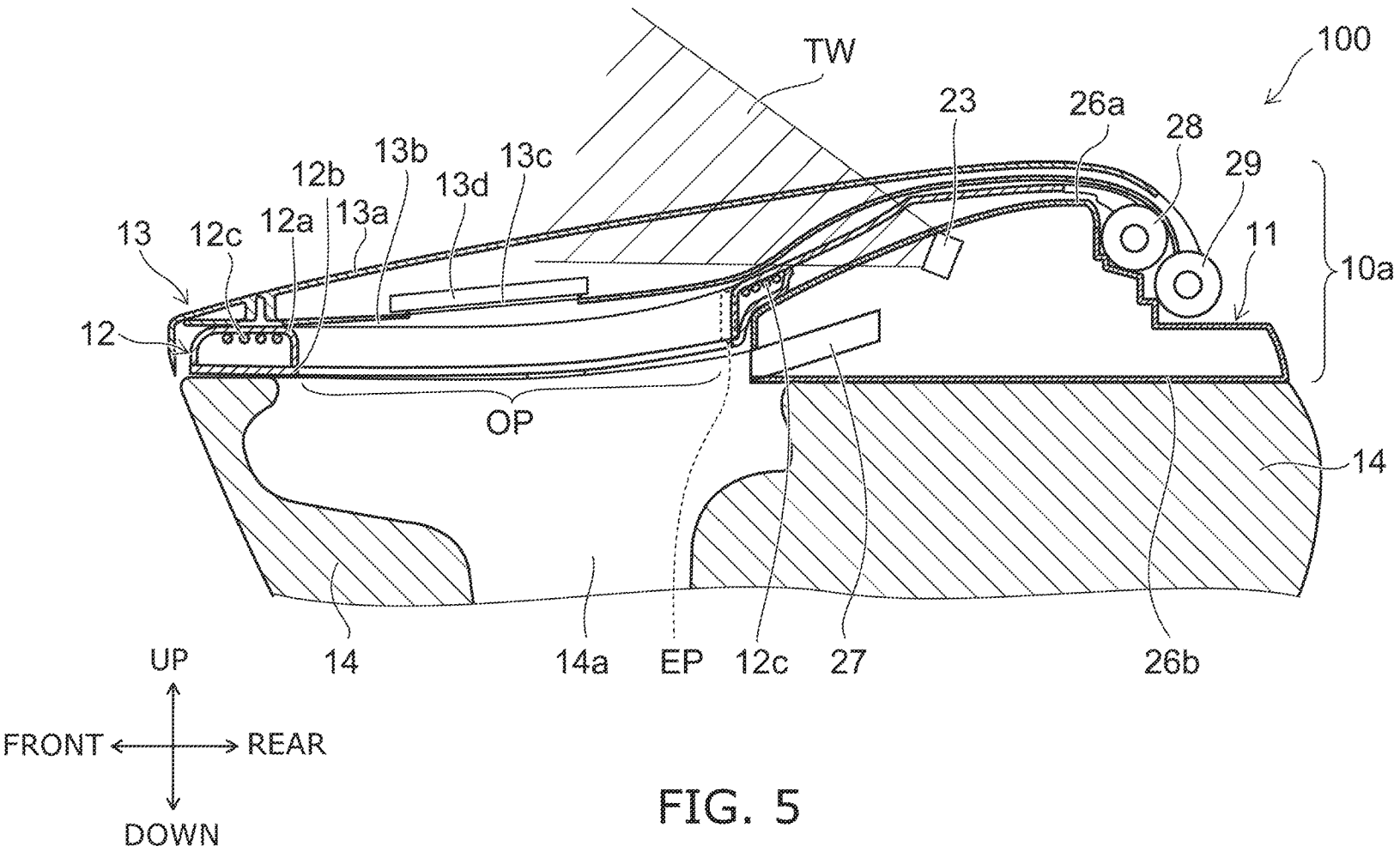
FIG. 5 is an enlarged cross-sectional view of the toilet seat apparatus vicinity of a toilet apparatus according to a first modification of the embodiment.

FIG. 5 is an enlarged cross-sectional view of the toilet seat apparatus vicinity of a toilet apparatus according to a first modification of the embodiment.

Instead of the configuration of the toilet seat illustrated in FIG. 2, the toilet seat apparatus according to the embodiment may have the configuration of the toilet seat illustrated in FIG. 5. Namely, in the toilet seat apparatus 10 illustrated in FIG. 2, the radio wave TW that is radiated from the radio wave sensor 23 passes through the upper plate 12*a* and the lower plate 12*b* and propagates frontward of the toilet seat apparatus 10. Conversely, in a toilet seat apparatus 10*a* illustrated in FIG. 5, the upper plate 12*a* and the lower plate 12*b* are provided around the opening OP of the toilet seat 12; but the lower plate 12*b* is linked to the upper plate 12*a* rearward of the opening OP; and only the upper plate 12*a* extends rearward. Therefore, the radio wave TW that is radiated from the radio wave sensor 23 passes through only the upper plate 12*a* to travel frontward of the toilet seat apparatus 10.

In the toilet seat apparatus according to the modification as well, because the thickness of the upper plate 12*a* is uniform at the radio wave sensor 23 vicinity, it is possible to radiate the radio wave TW substantially uniformly frontward of the radio wave sensor 23; and it is possible to sense the sensing object such as the user, etc., of the toilet apparatus with high precision.

Second Modification

Figure 6:
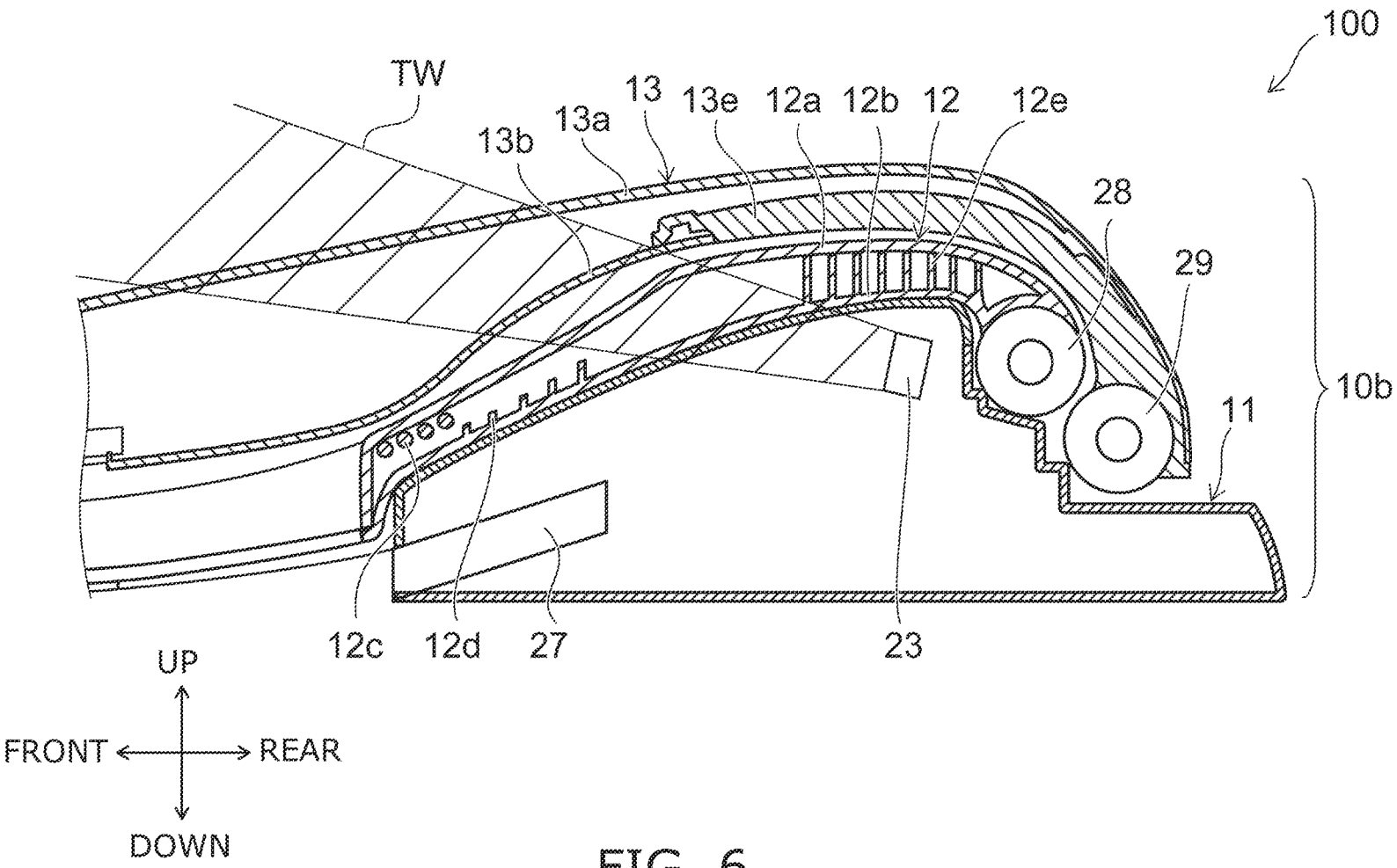
FIG. 6 is an enlarged cross-sectional view of the toilet seat apparatus vicinity of a toilet apparatus according to a second modification of the embodiment.

FIG. 6 is an enlarged cross-sectional view of the toilet seat apparatus vicinity of a toilet apparatus according to a second modification of the embodiment.

The toilet seat apparatus 10*b* according to the second modification illustrated in FIG. 6 is the toilet seat apparatus 10 illustrated in FIG. 2 that further includes a toilet seat reinforcing part 12*d*, a toilet seat reinforcing part 12*e*, and a toilet lid reinforcing part 13*e*.

The toilet seat reinforcing parts 12*d* and 12*e* are provided at the upper surface of the lower plate 12*b* at the rear of the toilet seat 12. In other words, the toilet seat reinforcing part 12*d* and the toilet seat reinforcing part 12*e* are provided in the interior of the toilet seat 12 and are positioned between the upper plate 12*a* and the lower plate 12*b*.

More specifically, the toilet seat reinforcing part 12*d* is provided frontward of the radio wave sensor 23 in the interior of the toilet seat 12. For example, the position in the vertical direction of at least a portion of the toilet seat reinforcing part 12*d* is the same as the position in the vertical direction of at least a portion of the radio wave sensor 23. The toilet seat reinforcing part 12*e* is provided above the radio wave sensor 23 in the interior of the toilet seat 12.

The toilet seat reinforcing parts 12*d* and 12*e* are, for example, multiple protrusions including a resin and are formed as one body with the lower plate 12*b*. For example, the toilet seat reinforcing parts 12*d* and 12*e* are provided to be continuous from the left-side end portion of the toilet seat 12 interior to the right-side end portion of the toilet seat 12 interior.

The radio wave TW is radiated through the region between the toilet seat reinforcing parts 12*d* and 12*e*. In other words, the toilet seat reinforcing parts 12*d* and 12*e* are not provided in the area where the radio wave TW is substantially radiated so that the thickness of the toilet seat 12 of the portion where the radio wave TW passes through is uniform. Thereby, even in the case where the toilet seat reinforcing parts 12*d* and 12*e* are provided, it is possible to suppress the decrease of the radio wave intensity frontward of the radio wave sensor 23 and sense the sensing object such as the user of the toilet apparatus, etc., with high precision. As described above, the area where the radio wave TW is substantially radiated is the region where the radiated radio wave has a radio wave intensity not less than 30% of the maximum radio wave intensity.

In the case where the toilet seat rotation part 28 is provided rearward of the radio wave sensor 23, the distance between the toilet seat rotation part 28 and the rear end of the opening OP is long compared to the case where the toilet seat rotation part 28 is provided frontward of the radio wave sensor 23. In other words, the distance between the portions supporting the upper plate 12*a* from below is longer. Therefore, when the user of the toilet apparatus 100 is seated on the toilet seat 12, the force that is applied to the upper plate 12*a* becomes large. If the force applied to the upper plate 12*a* is large, there is a possibility that the upper plate 12*a* may be damaged.

In the toilet seat apparatus 10*b* according to the modification, the toilet seat reinforcing part 12*d* is provided in the toilet seat 12 interior. By providing the toilet seat reinforcing part 12*d*, even in the case where the upper plate 12*a* is deformed when seated, the toilet seat reinforcing part 12*d* supports the upper plate 12*a* from below; and excessive deformation of the upper plate 12*a* is suppressed. Accordingly, according to the modification, even in the case where the toilet seat 12 is set to be long in the frontward/rearward direction to increase the sensing precision of the radio wave sensor 23, the likelihood of damage of the toilet seat 12 occurring can be reduced.

If the toilet seat reinforcing part 12*d* contacts the upper plate 12*a*, a large force is applied to the toilet seat reinforcing part 12*d* when the user is seated on the toilet seat 12; and there is a possibility that the toilet seat reinforcing part 12*d* may be damaged. Therefore, it is desirable for the toilet seat reinforcing part 12*d* to be provided to be separated from the upper plate 12*a* in the vertical direction. According to such a structure, the upper plate 12*a* is supported from below by the toilet seat reinforcing part 12*d* when the upper plate 12*a* is deformed while the upper plate 12*a* supports the weight of the user; and excessive deformation of the upper plate 12*a* can be suppressed. It is desirable for the toilet seat reinforcing part 12*d* not to be provided in contact with the heating unit 12*c* when the upper plate 12*a* is deformed downward.

If the toilet seat rotation part 28 is provided rearward of the radio wave sensor 23 and the length in the frontward/rearward direction of the toilet seat 12 is lengthened, the force that is necessary to rotate the toilet seat 12 becomes large; and a large force is applied at the toilet seat rotation part 28 vicinity of the toilet seat 12. If a large force is applied locally to the toilet seat 12, there is a possibility that the toilet seat 12 may be damaged. Also, there is a possibility that deformation may occur at the toilet seat rotation part 28 vicinity of the toilet seat 12 when rotating; and the rotation operation of the toilet seat 12 may become unstable.

For these aspects, in the toilet seat apparatus 10*b* according to the modification, the toilet seat reinforcing part 12*e* is provided in the interior of the toilet seat 12 above the radio wave sensor 23. By providing the toilet seat reinforcing part 12*e*, the strength of the portion where the force is applied when rotating can be increased; the likelihood of damage of the toilet seat 12 occurring can be reduced; and the rotation operation of the toilet seat 12 can be stabilized further. Therefore, misdetection of the toilet seat as a human body is suppressed; and the performance of the radio wave sensor also is stabilized.

The force that is applied when seated is smaller at the portion where the toilet seat reinforcing part 12*e* is provided than at the portion where the toilet seat reinforcing part 12*d* is provided. Therefore, it is desirable for the toilet seat reinforcing part 12*e* to be provided in contact with the upper plate 12*a* to effectively increase the strength at the toilet seat rotation part 28 vicinity of the toilet seat 12.

The rear end of the toilet lid reinforcing part 13*e* is linked to the toilet lid rotation part 29; and the side end and front end of the toilet lid reinforcing part 13*e* are linked to the lower plate 13*b*. Therefore, when rotating the toilet lid 13, a force is transmitted from the toilet lid rotation part 29 to the toilet lid 13 via the toilet lid reinforcing part 13*e*; and the toilet lid 13 rotates. Although the portions having functions are linked to each other in the example illustrated in FIG. 6 by forming the toilet lid reinforcing part 13*e* and the toilet lid rotation part 29 as one body, these members may be provided as separate bodies and linked to each other.

As illustrated in FIG. 1B, for example, the toilet lid reinforcing part 13*e* is provided in the center of the rear of the toilet lid 13. Also, in the state in which the toilet lid 13 is closed as illustrated in FIG. 6, the toilet lid reinforcing part 13*e* extends toward the front and is provided from the toilet lid rotation part 29 to a region above the radio wave sensor 23. For example, the toilet lid reinforcing part 13*e* is included with the lower plate 13*b* in a portion of the lower surface of the toilet lid 13. Or, the toilet lid reinforcing part 13*e* may be provided in the interior of the toilet lid 13 and may be linked to at least one of the upper plate 13*a* or the lower plate 13*b*.

The thickness of the toilet lid reinforcing part 13*e* is thicker than the thickness of the lower plate 13*b*. The toilet lid reinforcing part 13*e* includes a material such as a metal (e.g., SUS304), etc., and has a higher strength than the toilet lid 13 (the upper plate 13*a* and the lower plate 13*b*).

For the toilet lid 13 as well, similarly to the toilet seat 12, because the toilet lid rotation part 29 is provided rearward of the radio wave sensor 23, a large force is applied to the toilet lid rotation part 29 vicinity of the toilet lid 13 when the toilet lid 13 is rotated by the toilet lid rotation part 29. If a large force is applied locally to the toilet lid 13, there is a possibility that the toilet lid 13 may be damaged.

In the toilet seat apparatus 10*b* according to the modification, the toilet lid reinforcing part 13*e* is provided; and the rotation of the toilet lid 13 is performed by the toilet lid rotation part 29 via the toilet lid reinforcing part 13*e*. As described above, the toilet lid reinforcing part 13*e* has a higher strength than the toilet lid 13. Therefore, compared to the case where the rotation of the toilet lid 13 is performed directly by the toilet lid rotation part 29, the force that is applied to the toilet lid 13 can be small; and the likelihood of damage of the toilet lid 13 can be reduced. The toilet lid reinforcing part 13*e* is provided from the toilet lid rotation part 29 to the region above the radio wave sensor 23 and is configured so that the surface area of the linking portion between the toilet lid 13 and the toilet lid reinforcing part 13*e* is large. According to such a structure, the force that is applied to the linking portion between the toilet lid 13 and the toilet lid reinforcing part 13*e* when rotating the toilet lid 13 can be reduced even further; and the likelihood of damage of the toilet lid 13 occurring can be reduced further. Misdetection of the toilet lid as a human body is suppressed; and the performance of the radio wave sensor also is stabilized.

The embodiments of the invention have been described above. However, the invention is not limited to the above description. Those skilled in the art can appropriately modify the design of the above embodiments. Such modifications are also encompassed within the scope of the invention as long as they include the features of the invention. For instance, the shape, dimension, material, and placement of each element of the toilet device 1 are not limited to those illustrated above, but can be appropriately modified.

Furthermore, the elements of the above embodiments can be combined with each other as long as technically feasible. Such combinations are also encompassed within the scope of the invention as long as they include the features of the invention.

What is claimed is:

1. A toilet seat apparatus, comprising:

a main part mounted at a rear upper part of a toilet;

a toilet seat provided rotatably with respect to the main part, a rear end part of the toilet seat being positioned at a rear part of the main part; and a radio wave sensor being provided in an interior of the main part and using a radio wave to sense a human body, the rear end part of the toilet seat being positioned rearward of the radio wave sensor, in a state in which the toilet seat is lowered, the toilet seat covering the radio wave sensor in a vertical direction, and the radio wave passing through the toilet seat and being radiated frontward of the radio wave sensor.

2. The apparatus according to claim 1, wherein a thickness of a portion of the toilet seat where the radio wave passes through in the state in which the toilet seat is lowered is uniform.

3. The apparatus according to claim 1, wherein at least a portion of the radio wave sensor is positioned higher than a rear end part of an opening of the toilet seat in the state in which the toilet seat is lowered.

4. The apparatus according to claim 1, further comprising a heating unit provided in the toilet seat interior and including a metal, at least a portion of the radio wave sensor being positioned higher than the heating unit in the state in which the toilet seat is lowered.

5. The apparatus according to claim 1, further comprising a toilet seat rotation part supporting the toilet seat pivotally with respect to the main part, the toilet seat rotation part being provided rearward of the radio wave sensor.

6. The apparatus according to claim 5, further comprising a first toilet seat reinforcing part being provided in the interior of the toilet seat above the main part, being positioned frontward of the radio wave sensor, and supporting an upper plate of the toilet seat from below when the upper plate is deformed downward.

7. The apparatus according to claim 6, further comprising a second toilet seat reinforcing part being provided in the interior of the toilet seat above the main part, being positioned above and rearward of the radio wave sensor, and contacting the upper plate of the toilet seat.

8. The apparatus according to claim 7, wherein the radio wave sensor radiates the radio wave frontward through a region between the first toilet seat reinforcing part and the second toilet seat reinforcing part.

9. The apparatus according to claim 5, further comprising:

a toilet lid;

a toilet lid rotation part supporting the toilet lid pivotally with respect to the main part; and a toilet lid reinforcing part linked to the toilet lid rotation part and the toilet lid, the toilet lid rotation part being provided rearward of the radio wave sensor, the toilet lid reinforcing part being provided from the toilet lid rotation part to a region above the radio wave sensor.

10. The apparatus according to claim 1, further comprising a toilet lid including a light source unit, at least a portion of the radio wave sensor being positioned higher than the light source unit in a state in which the toilet lid is closed.

* * * * *